US010655380B2

(12) United States Patent
Kinville et al.

(10) Patent No.: US 10,655,380 B2
(45) Date of Patent: May 19, 2020

(54) MULTICOLOR THRESHOLD

(71) Applicant: REESE ENTERPRISES, INC., Rosemount, MN (US)

(72) Inventors: Patrick James Kinville, Bloomington, MN (US); Robert T. Ellingson, Social Circle, GA (US)

( * ) Notice: Subject to any disclaimer, the term of this patent is extended or adjusted under 35 U.S.C. 154(b) by 0 days.

(21) Appl. No.: 15/979,718

(22) Filed: May 15, 2018

(65) Prior Publication Data

US 2019/0352957 A1 Nov. 21, 2019

(51) Int. Cl.
*E06B 1/70* (2006.01)

(52) U.S. Cl.
CPC ..... *E06B 1/70* (2013.01)

(58) Field of Classification Search
CPC ..... E06B 1/70
See application file for complete search history.

(56) References Cited

U.S. PATENT DOCUMENTS 4,946,727 A * 8/1990 Kessler ..... A47B 95/043 428/99
5,581,949 A * 12/1996 Wu ..... E06B 1/70 49/467
5,673,517 A * 10/1997 Stanclift ..... E06B 1/70 49/468
6,289,635 B1 * 9/2001 Procton ..... E06B 1/70 49/467
7,062,881 B2 * 6/2006 Rissone ..... E06B 1/70 49/467
7,350,336 B2 * 4/2008 Bennett ..... E06B 1/70 49/467
8,146,313 B2 * 4/2012 Proot ..... B26B 29/06 52/464
8,186,114 B2 * 5/2012 Rissone ..... E06B 7/2316 49/467
8,186,118 B2 * 5/2012 Neuhofer ..... E04F 19/061 52/312
8,286,403 B2 * 10/2012 Schacht ..... E04F 15/02005 52/211
8,572,912 B2 * 11/2013 Neuhofer, Jr. ..... E04F 19/0463 52/211
8,955,281 B2 * 2/2015 Pietruczynik ..... B29C 59/04 52/580
9,469,982 B2 * 10/2016 Belanger ..... E04C 2/42
9,476,247 B2 * 10/2016 Ball ..... A47K 3/34
9,528,314 B2 * 12/2016 Mitchell ..... E06B 7/18
2013/0199102 A1 * 8/2013 Rager-Frey ..... E06B 1/70 49/469
2015/0033633 A1 * 2/2015 Tarrega Lloret .... E05D 15/0656 49/406

* cited by examiner

*Primary Examiner* — Catherine A Kelly
(74) *Attorney, Agent, or Firm* — Smith Tempel Blaha LLC; Matthew T. Hoots

(57) ABSTRACT

Disclosed is a multilayered, multicolored threshold for transitioning from one flooring surface to another, such as at a doorway. An exemplary multicolor threshold includes a top layer comprised of a first compound and a main body portion comprised of a second compound.

14 Claims, 5 Drawing Sheets

MULTICOLOR THRESHOLD

BACKGROUND

Embodiments of the present solution are generally directed to the field of doorway thresholds for transitioning flooring between adjacent rooms and, more specifically, to an extruded threshold having at least two colors.

Doorway thresholds such as those commonly used in hotels and commercial spaces are extruded from polymers such as a plastic or a rubber compound. As would be understood by one of ordinary skill in the art, the polymer from which a threshold is extruded may include a pigment in order that the threshold takes on a desired color and/or aesthetic appearance. Pigments, however, range in cost and, as such, may be a significant contributor to the price of a threshold device. Because rubber or plastic thresholds are typically "low expense" items for designers of hospitality or commercial spaces, prior art thresholds are offered only in a limited range of colors—i.e., they are offered in colors associated with a relatively low cost pigment (usually black or brown).

The high cost of some pigment colors makes prior art threshold devices economically unfeasible for the threshold industry to offer to designers in any variety of finishes, textures and/or colors. Designers, however, have an unfilled need for cost effective thresholds offered in a variety of aesthetic appearances. Therefore, there is a need in the art for a doorway threshold that may be manufactured in a variety of finishes, textures and/or colors without a significant cost increase over prior art thresholds. Moreover, there is a need in the art for a threshold that minimizes the use of certain pigments such that a desired aesthetic appearance is achieved without unnecessary use of the certain pigments. In summary, there is a need in the art for a multicolored threshold.

These needs, as well as other needs in the art, are addressed in the various embodiments of the solution as presented herein.

BRIEF SUMMARY

The various embodiments, features and aspects of the present invention overcome and/or fill some or all of the above-noted needs in the prior art. Embodiments include a multilayered, multicolored threshold for transitioning from one flooring surface to another, such as at a doorway.

An exemplary multicolor threshold includes a top layer comprised of a first compound and a main body portion comprised of a second compound. The main body portion of the exemplary embodiment comprises a central, longitudinal groove on the underside and a first foot aspect extending from the base of the longitudinal groove outwards to define a lower edge of one side of the threshold. The main body portion also comprises a first upper wing above the first foot aspect that cooperates with the first foot aspect to define a first longitudinal channel that runs down the edge of the one side of the threshold. Certain embodiments may have a mirror image arrangement on the opposite side of the threshold such that there is a second foot aspect, second upper wing, and second longitudinal channel that runs down the edge of the second side of the threshold. Certain other embodiments may feature a ramp on the side of the threshold that is distal to the side featuring the first longitudinal channel.

The longitudinal channel(s) may be configured to receive one of a carpet surface, a tile surface, and a wood surface or any other flooring surface that would occur to one of skill in the art. The first compound that forms the top layer and the second compound that forms the main body portion may contain pigments, respectively, of different colors. In some embodiments, the first compound used for the top layer may contain a plurality of pigments such that the top layer exhibits a plurality of colors. For those embodiments that feature a plurality of colors in the top layer, the colors may be combined or swirled or mixed to mimic a natural material surface such as, but not limited to, a marble, a quartz, or a wood.

The above-described and additional features may be considered, and will become apparent in conjunction with the drawings, in particular, and the detailed description that follow.

BRIEF DESCRIPTION OF THE SEVERAL VIEWS OF THE DRAWING

In the drawings, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION

The present disclosure is directed towards providing a multicolored threshold that may be used as a transition piece for flooring in adjacent rooms or spaces. Embodiments of the solution leverage a co-extrusion process to create a main body with a top layer. The main body portion of a threshold, according to the solution, may be comprised of a low cost polymer and take any structural shape suitable for a given application. By contrast, the top layer portion of a threshold, according to the solution, may be comprised of a polymer with a customized color and/or finish and/or texture. The top layer portion may be visible when the threshold is installed, while the main body portion is not. In this way, embodiments of the solution may provide a desired aesthetic appearance when installed, without having to construct the entire threshold from the particular material used for the top layer portion.

In this description, the terms "polymer," "polymer compound," "compound" and the like are used interchangeably and, unless specifically defined, envision any material suitable for co-extrusion of a threshold device such as, but not limited to, an elastomer, a plastic, a thermoplastic polymer such as polypropylene, polyethylene, acrylonitrile butadiene styrene ("ABS"), polyvinyl chloride ("PVC"), Santoprene® (compound of EPDM rubber and polypropylene), Hytrel® (a thermoplastic polyester elastomer), Alcryn® (chlorinated olefin interpolymer alloy), etc.

In this description, exemplary embodiments of a multicolor threshold are shown and described as being constructed from two different compounds of two different colors. It will be understood, however, that the scope of a multicolor threshold is not limited to a threshold comprised of two different compounds of two different colors. For example, one of ordinary skill in the art reviewing this description and figures would understand that a multicolor threshold may be comprised of any number of compounds and/or compounds of different colors in order to generate a desired aesthetic appearance. The various compounds in a given embodiment of the solution may be of the same type and differ only in color. In other embodiments of the solution, various compounds may differ in chemical construction as well as color. Combinations of compounds suitable for co-extrusion of a threshold according to the solution will occur to those of skill in the art.

Turning now to the figures in which like labels refer to like elements throughout the several views, various embodiments, aspects and features of the present invention are presented.

Figure 1:
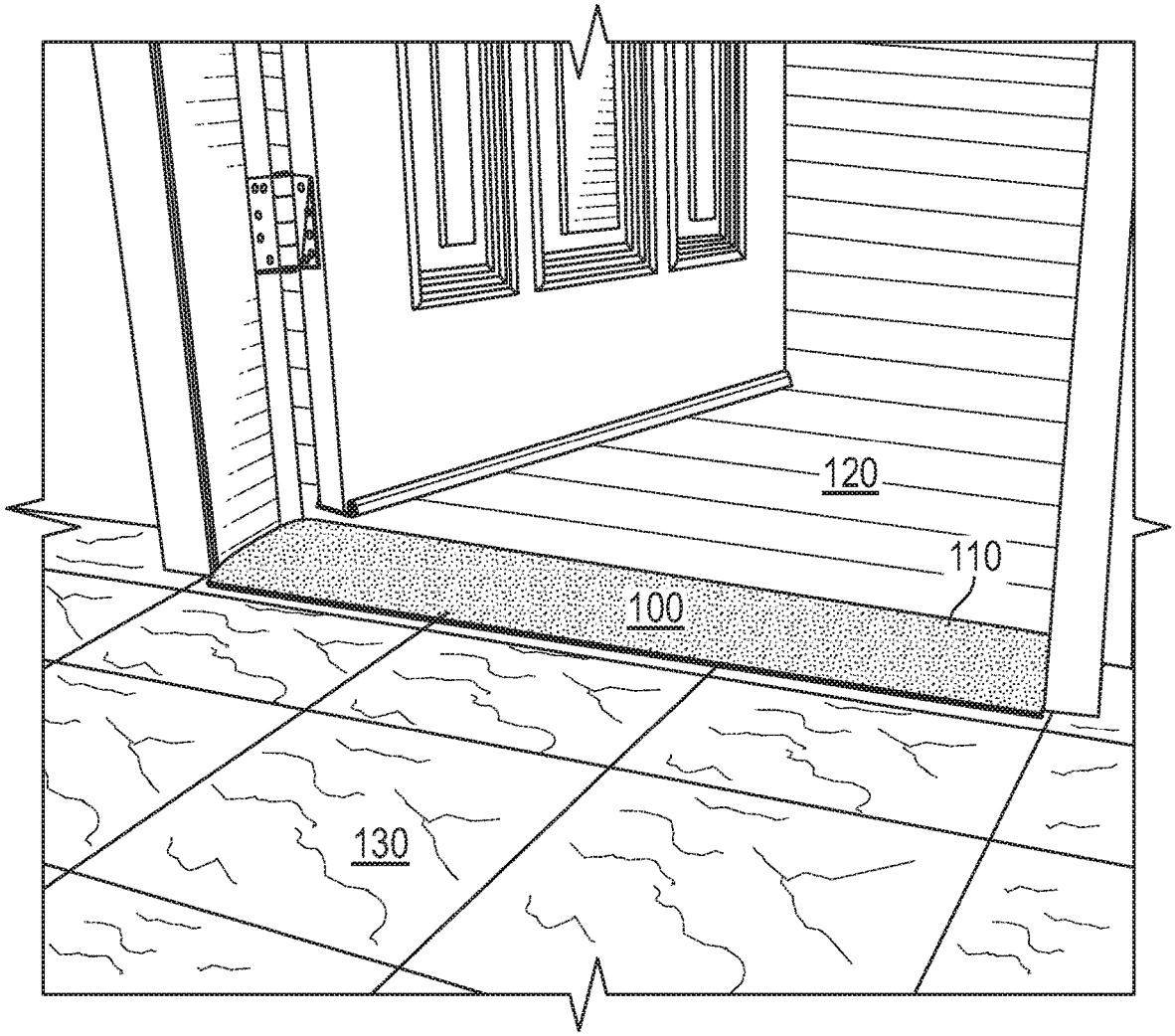
FIG. 1 illustrates an exemplary application of a multicolor threshold, shown in a doorway to transition from a wood flooring surface to a tile surface.

FIG. 1 illustrates an exemplary application of a multicolor threshold, shown in a doorway to transition from a wood flooring surface to a tile surface. The illustration is offered for contextual purposes only and is not meant to suggest that embodiments of the solution are limited to threshold applications similar to the illustration. In the FIG. 1 illustration, a multicolor threshold 100 is installed in a doorway that transitions from a space with a wooden flooring surface 120 to a space with a tile flooring surface 130. As would be understood by one of ordinary skill in the art, the wooden flooring surface 120 may define a plane that is higher than a plane defined by the tiled flooring surface 130 and, as such, require a threshold at the doorway for transitioning from one surface to the other. Also, because the flooring surfaces 120, 130 differ in appearance, a threshold provides for a visually aesthetic transition from one surface to the next.

Advantageously, because embodiments of the solution provide for a threshold 100 that includes a top layer 110, the desired visual appearance of an installed threshold 100 may not require that the entire threshold be constructed from a material used in the top layer 110. That is, a less expensive or different polymer compound may be used in a main body portion of the multicolor threshold 100 than what is used in the top layer 110.

Figure 2:
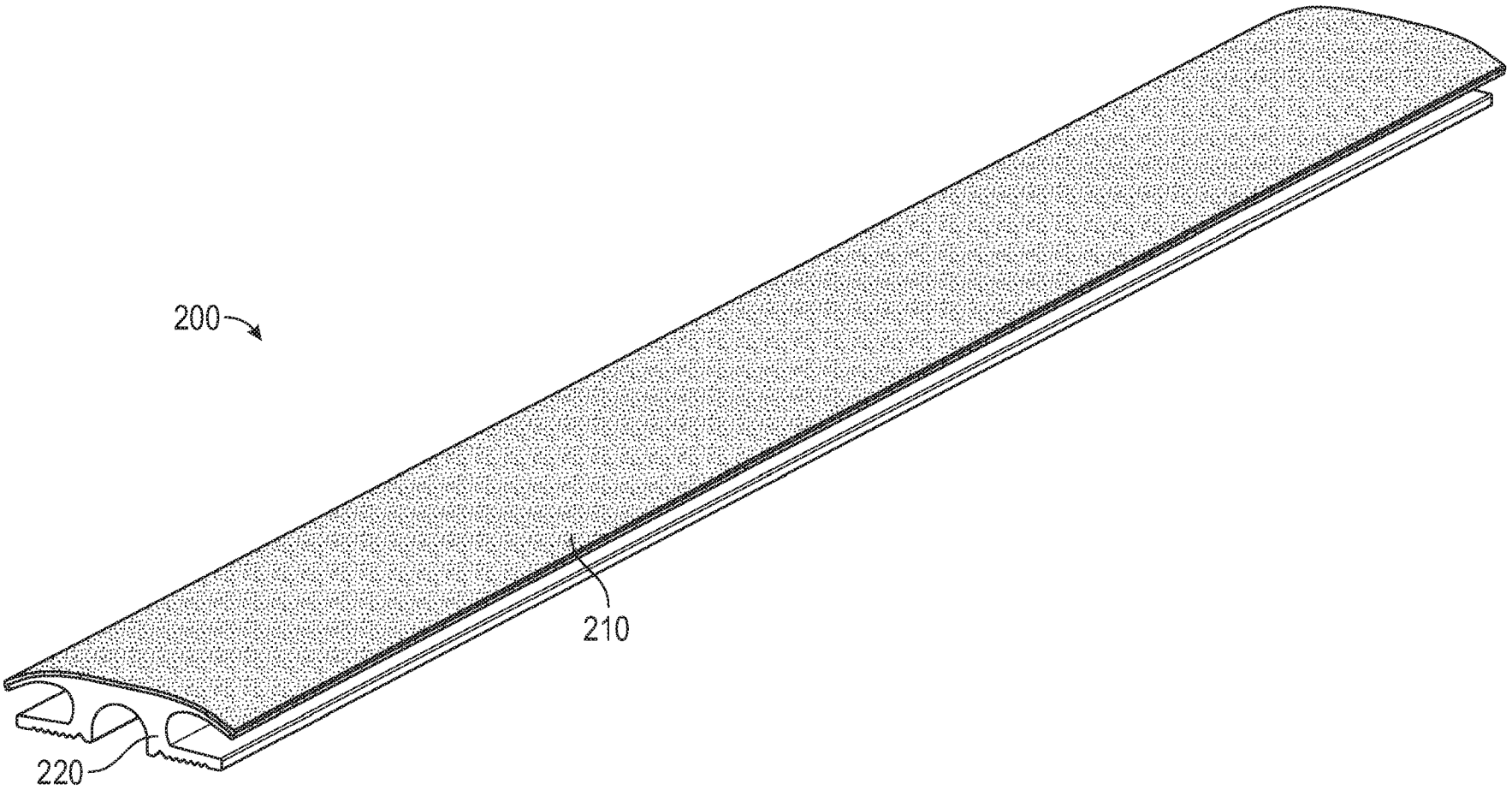
FIG. 2 is a perspective view of an exemplary embodiment of a multicolor threshold configured for a carpet-to-carpet transition.

FIG. 2 is a perspective view of an exemplary embodiment of a multicolor threshold 200 configured for a carpet-to-carpet transition. More detail regarding the multicolor threshold 200 will be provided in association with the description of FIG. 3. Notably, thresholds according to the solution may be extruded in any length required for a given application or, optionally for some embodiments, may be extruded and cut to length in the field. As can be seen from the FIG. 2 illustration, the exemplary multicolor threshold 200 includes a main body portion 220 and a top layer 210. The top layer 210 may be made from a material that is of a different color and/or composition from that which is used to make the main body portion 220.

It is envisioned that the top layer 210 may be substantially one color or may be a composite of colors. If a composite of colors, the top layer 210 may be "swirled" or otherwise mixed to mimic a different surface type such as, but not limited to, a marble or a wood. Moreover, it is envisioned that the top layer 210 may include structural surface aspects or textures, such as grooves or raised areas, in order to provide a functional quality (such as a non-slip quality, for example) and/or an aesthetic quality (such as a wood grain, for example).

Figure 3:
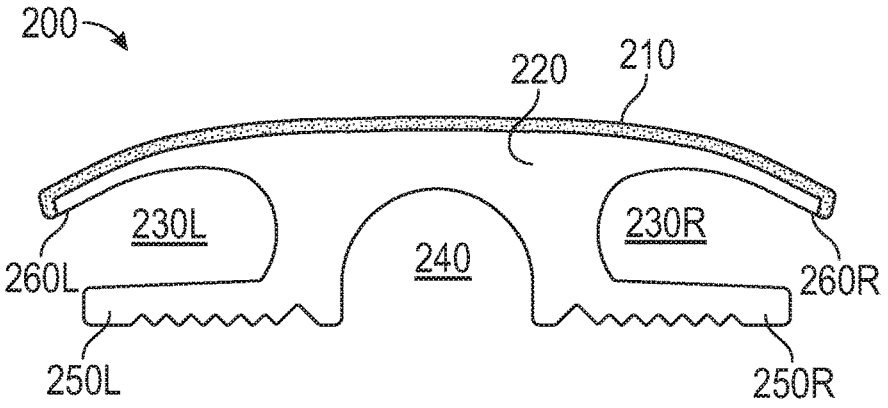
FIG. 3 illustrates a profile of the multicolor threshold embodiment of FIG. 2.

FIG. 3 illustrates a profile of the multicolor threshold embodiment 200 of FIG. 2. The multicolor threshold 200 is configured for a carpet-to-carpet transition. Multicolor threshold 200 generally comprises a top layer 210 and a main body portion 220. The top layer 210 and the main body portion 220 may be co-extruded from different and distinct compounds. In this way, the top layer 210 may be constructed from a relatively expensive compound without overly impacting the overall cost of production for the multicolor threshold 200.

The main body portion 220 defines a central groove 240 that may provide a degree of flexibility to the threshold 200. The main body portion 220 includes left and right foot aspects, 250L and 250R, respectively. The foot aspects 250 cooperate with upper wing aspects, 260L and 260R, respectively, to define longitudinal channels 230L and 230R, respectively. When the multicolor threshold 200 is installed, a carpet surface may be received into channels 230L and 230R, as would be understood by one of ordinary skill in the art. In this way, a user of an installed multicolor threshold 200 would visually perceive the carpet surfaces and the top layer 210.

Figure 4:
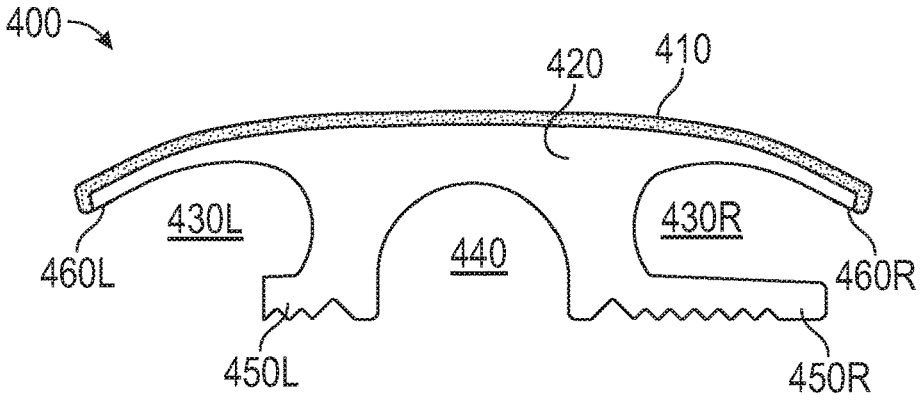
FIG. 4 illustrates a profile of a multicolor threshold embodiment configured for a tile-to-carpet transition.

FIG. 4 illustrates a profile of a multicolor threshold embodiment 400 configured for a tile-to-carpet transition. Multicolor threshold 400 generally comprises a top layer 410 and a main body portion 420. The top layer 410 and the main body portion 420 may be co-extruded from different and distinct compounds. In this way, the top layer 410 may be constructed from a relatively expensive compound without overly impacting the overall cost of production for the multicolor threshold 400.

The main body portion 420 defines a central groove 440 that may provide a degree of flexibility to the threshold 400. The main body portion 420 includes left and right foot aspects, 430L and 430R, respectively. The foot aspects 430 cooperate with upper wing aspects, 460L and 460R, respectively, to define longitudinal channels 430L and 430R, respectively. When the multicolor threshold 400 is installed, a carpet surface may be received into channel 430R and a tile surface into channel 430L, as would be understood by one of ordinary skill in the art. In this way, a user of an installed multicolor threshold 400 would visually perceive the carpet and tile surfaces and the top layer 410.

Figure 5:
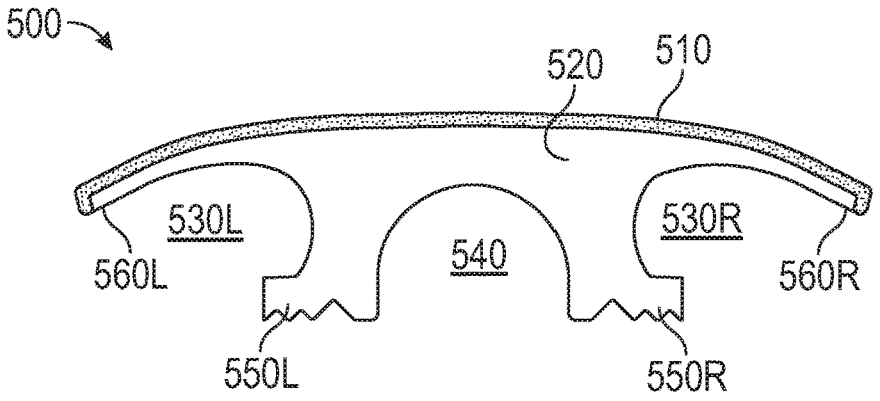
FIG. 5 illustrates a profile of a multicolor threshold embodiment configured for a tile-to-tile transition.

FIG. 5 illustrates a profile of a multicolor threshold embodiment 500 configured for a tile-to-tile transition. Multicolor threshold 500 generally comprises a top layer 510 and a main body portion 520. The top layer 510 and the main body portion 520 may be co-extruded from different and distinct compounds. In this way, the top layer 510 may be constructed from a relatively expensive compound without overly impacting the overall cost of production for the multicolor threshold 500.

The main body portion 520 defines a central groove 540 that may provide a degree of flexibility to the threshold 500. The main body portion 520 includes left and right foot aspects, 530L and 530R, respectively. The foot aspects 530 cooperate with upper wing aspects, 560L and 560R, respectively, to define longitudinal channels 530L and 530R, respectively. When the multicolor threshold 500 is installed, a tile surface may be received into channels 530L and 530R, as would be understood by one of ordinary skill in the art. In this way, a user of an installed multicolor threshold 500 would visually perceive the tile surfaces and the top layer 510.

Figure 6:
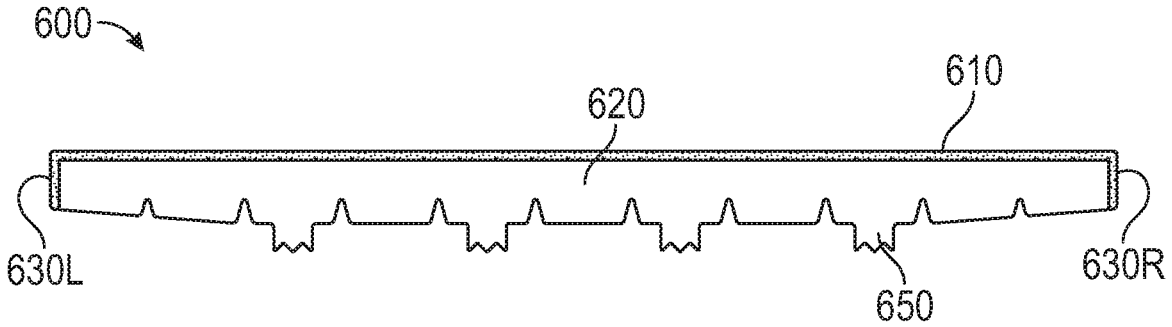
FIG. 6 illustrates a profile of a multicolor threshold embodiment configured for a communicating door transition.

FIG. 6 illustrates a profile of a multicolor threshold embodiment 600 configured for a communicating door transition such as may be typically found in a hotel having two adjoining rooms. Multicolor threshold 600 generally comprises a top layer 610 and a main body portion 620. The top layer 610 and the main body portion 620 may be co-extruded from different and distinct compounds. In this way, the top layer 610 may be constructed from a relatively expensive compound without overly impacting the overall cost of production for the multicolor threshold 600.

The main body portion 620 includes a series of longitudinal ridges 650. The ridges 650 may provide a desired coefficient of friction to prevent the threshold 600 from sliding out of position when installed and/or to add a degree of flexibility or cushion to the threshold 600. When the multicolor threshold 600 is installed, a flooring surface may be received beneath, or abutted to, edges 630L, 630R, as would be understood by one of ordinary skill in the art. In this way, a user of an installed multicolor threshold 600 would visually perceive the flooring surfaces and the top layer 610.

Figure 7:
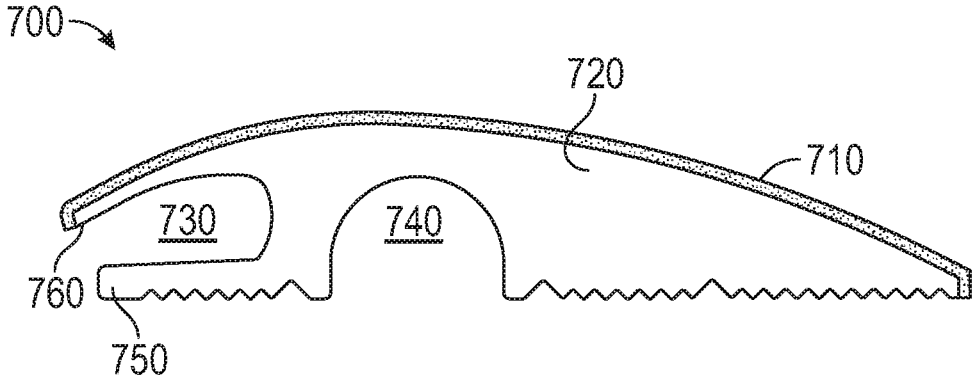
FIG. 7 illustrates a profile of a multicolor threshold embodiment configured for a carpet ramp transition.

FIG. 7 illustrates a profile of a multicolor threshold embodiment 700 configured for a carpet ramp transition. Multicolor threshold 700 generally comprises a top layer 710 and a main body portion 720. The top layer 710 and the main body portion 720 may be co-extruded from different and distinct compounds. In this way, the top layer 710 may be constructed from a relatively expensive compound without overly impacting the overall cost of production for the multicolor threshold 700.

The main body portion 720 defines a central groove 740 that may provide a degree of flexibility to the threshold 700. The main body portion 720 includes a foot aspect 750. The foot aspect 750 cooperates with upper wing aspect 760 to define longitudinal channel 730. When the multicolor threshold 700 is installed, a carpet surface may be received into channel 730, as would be understood by one of ordinary skill in the art. In this way, a user of an installed multicolor threshold 700 would visually perceive the carpet surface and the top layer 710.

Figure 8:
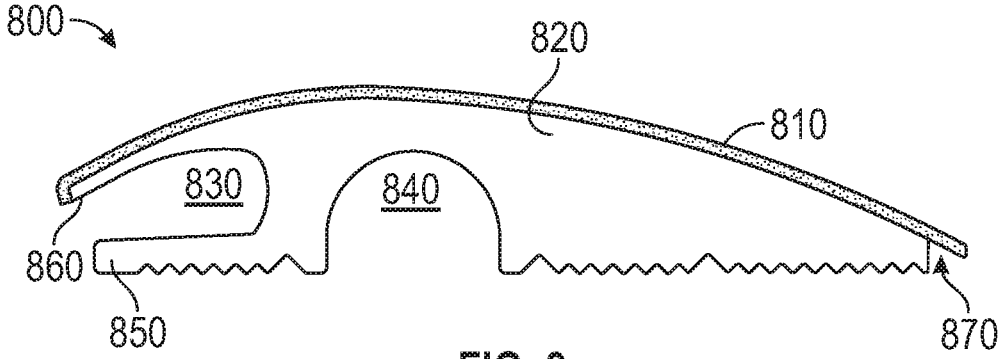
FIG. 8 illustrates a profile of a multicolor threshold embodiment configured for a tile-to-carpet ramp transition.

FIG. 8 illustrates a profile of a multicolor threshold embodiment 800 configured for a tile-to-carpet ramp transition. Multicolor threshold 800 generally comprises a top layer 810 and a main body portion 820. The top layer 810 and the main body portion 820 may be co-extruded from different and distinct compounds. In this way, the top layer 810 may be constructed from a relatively expensive compound without overly impacting the overall cost of production for the multicolor threshold 800.

The main body portion 820 defines a central groove 840 that may provide a degree of flexibility to the threshold 800. The main body portion 820 includes a foot aspect 850. The foot aspect 850 cooperates with upper wing aspect 860 to define longitudinal channel 830. Similarly, the top layer 810 extends beyond main body portion 820 to define a longitudinal recess 870. When the multicolor threshold 800 is installed, a carpet surface may be received into channel 830 and a tile surface may be received beneath recess 870, as would be understood by one of ordinary skill in the art. In this way, a user of an installed multicolor threshold 800 would visually perceive the carpet and tile surfaces and the top layer 810.

Figure 9:
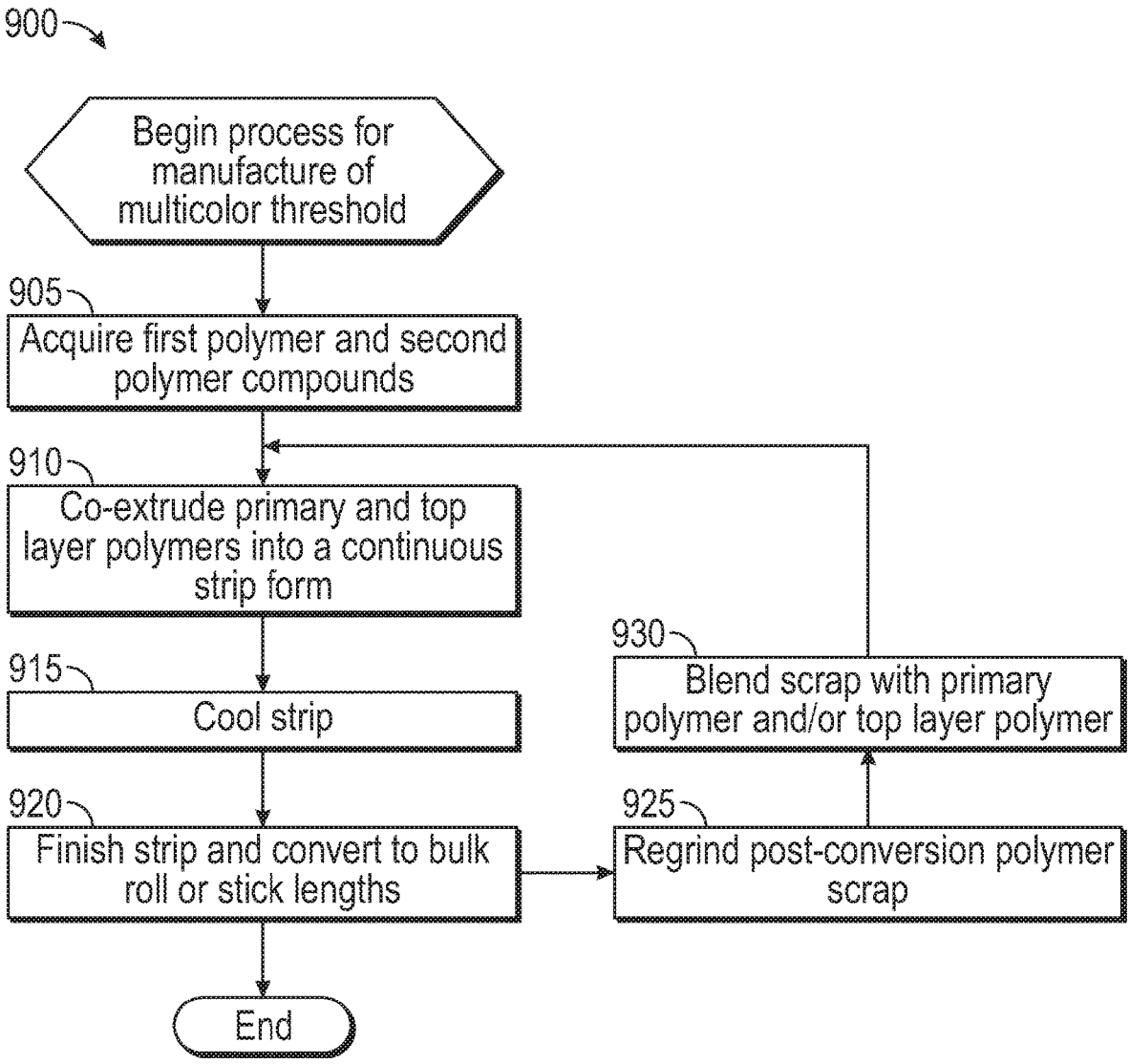
FIG. 9 is a logical flowchart illustrating an exemplary process for manufacture of an embodiment of a multicolor threshold.

FIG. 9 is a logical flowchart illustrating an exemplary process 900 for manufacture of an embodiment of a multicolor threshold. Although the exemplary process 900 describes manufacture of a bicolor embodiment of the solution, the scope of the solution is not limited bicolor thresholds. That is, it is envisioned that embodiments of a multicolor threshold may feature more than two colors and/or more than two polymer compounds. For example, an embodiment of a multicolor threshold may feature a main body comprised of a first compound of a first color and a top layer aspect comprised of two different compounds, i.e. a second compound of a second color and a third compound of a third color, such that the second and third compounds are swirled to suggest the appearance of a natural material such as marble.

Returning to the method 900, at block 905 a first polymer compound and a second polymer compound are acquired. The first polymer compound will form a main body portion of the multicolor threshold and the second polymer compound will form a top layer of the threshold. In application, the top layer will be visible to users. It is envisioned that the polymer compounds may be any material recognized by one of ordinary skill in the art to be suitable for use in a multicolor threshold including, but not limited to, an elastomer, a plastic, or a thermoplastic polymer such as polypropylene, polyethylene, acrylonitrile butadiene styrene ("ABS"), polyvinyl chloride ("PVC"), Santoprene® (compound of EPDM rubber and polypropylene), Hytrel® (a thermoplastic polyester elastomer), Alcryn® (chlorinated olefin interpolymer alloy), etc. It is also envisioned that the second polymer compound may be any material that is suitable for co-extrusion with the first polymer compound.

Returning to the method 900, the polymers may be in pelletized forms as would be understood by one of ordinary skill in the art, although the particular forms of the first and second polymer compounds are envisioned to be any form suitable for input into the process 900 or an alternative manufacturing process. At block 910, the first polymer compound and the second polymer compound may be input to an extruder, where they are pressurized and heated such that they can be co-extruded through a die, as is understood by one of ordinary skill in the art of rubber and/or plastic extrusion processes. Having been heated to, or near, a melt point, the first and second polymer compounds are forced through a die to form a continuous ribbon having a cross-sectional profile consistent with the shape of the given die. The co-extrusion at block 910 operates to cross-link the first and second polymer compounds such that a unitary ribbon or strip is formed.

At block 915, the continuous strip is cooled such that the first and second polymer compounds regain their memory properties, tensile strength, durability, and the like. As is understood by those of ordinary skill in the art of rubber and/or plastic extrusion, the strip may be cooled any number of ways including, but not limited to, exposure to a water bath or air. Once the strip is cooled, at block 920 it may be "cleaned up" by removing excess polymer and rolled into a bulk roll form of finished product, as would be understood by one of ordinary skill in the art. In application, the bulk roll may be "cut to length" in the field for use in specific threshold applications. Alternatively, the strip may be pre-converted into "sticks" or lengths useful for accommodating expected threshold applications. In some embodiments of the method 900, any scrap polymer left over from the conversion at block 920 may be reground at block 925 and blended back into the first polymer compound and/or the second polymer compound at block 930 prior to extrusion at block 910.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A multicolor threshold device configured to be installed as a transition between two juxtaposed flooring surfaces, comprising:

a top layer comprised of a first rubber polymer compound; and a main body portion comprised of a second rubber polymer compound and formed as a single unitary member, wherein the main body portion comprises:

a central, longitudinal groove;

a first foot aspect; and a first upper wing, wherein the first upper wing cooperates with the first foot aspect to define a first longitudinal channel;

wherein the first rubber polymer compound and the second rubber polymer compounds form the top layer and main body portion, respectively;

wherein the first rubber polymer compound and the second rubber polymer compound are chemically cross-linked; and wherein the top layer overlays the main body portion such that it conceals at least a substantial portion of the main body portion from view when the multicolor threshold is installed as a transition between the two juxtaposed flooring surfaces.

2. The multicolor threshold device of claim 1, wherein at least the first rubber polymer compound contains a pigment.

3. The multicolor threshold device of claim 1, wherein the first rubber polymer compound contains a plurality of pigments such that the top layer exhibits a plurality of colors.

4. The multicolor threshold device of claim 3, wherein the plurality of colors cooperate to mimic a natural material.

5. The multicolor threshold device of claim 4, wherein the natural material is one of a marble, a wood, and a quartz.

6. The multicolor threshold device of claim 1, wherein the first longitudinal channel is configured to receive one of a carpet surface, a tile surface, and a wood surface.

7. The multicolor threshold device of claim 1, wherein the main body portion further comprises a ramp distal to the first longitudinal channel.

8. The multicolor threshold device of claim 1, further comprising:

a second foot aspect; and a second upper wing, wherein the second upper wing cooperates with the second foot aspect to define a second longitudinal channel.

9. The multicolor threshold device of claim 8, wherein the second longitudinal channel is configured to receive one of a carpet surface, a tile surface, and a wood surface.

10. A multicolor threshold device configured to be installed as a threshold between a pair of communicating doors, comprising:

a top layer comprised of a first rubber polymer compound; and a main body portion comprised of a second rubber polymer compound and formed as a single unitary member, wherein the main body portion comprises a plurality of longitudinal ridges;

wherein the first rubber polymer compound and the second rubber polymer compounds form the top layer and main body portion, respectively;

wherein the first rubber polymer compound and the second rubber polymer compound are chemically cross-linked; and wherein the top layer overlays the main body portion such that it conceals at least a substantial portion of the main body portion from view when the multicolor threshold is installed as a threshold between the pair of communicating doors.

11. The multicolor threshold device of claim 10, wherein at least the first rubber polymer compound contains a pigment.

12. The multicolor threshold device of claim 10, wherein the first rubber polymer compound contains a plurality of pigments such that the top layer exhibits a plurality of colors.

13. The multicolor threshold device of claim 12, wherein the plurality of colors cooperate to mimic a natural material.

14. The multicolor threshold device of claim 13, wherein the natural material is one of a marble, a wood, and a quartz.

* * * * *